United States Patent [19]

Mitzel et al.

[11] Patent Number: 4,553,312

[45] Date of Patent: Nov. 19, 1985

[54] DEVICE FOR REMOVING A BAND FROM A SHEET BUNDLE

[75] Inventors: Wilhelm Mitzel, Neu-Keferloh; Josef Geier; Karl Leuthold, both of Munich, all of Fed. Rep. of Germany

[73] Assignee: GAO Gesellschaft fur Automation und Organisation mbH, Fed. Rep. of Germany

[21] Appl. No.: 520,714

[22] Filed: Aug. 5, 1983

[30] Foreign Application Priority Data

Aug. 10, 1982 [DE] Fed. Rep. of Germany ..... 3229765

[51] Int. Cl.[4] ..... B23D 15/04

[52] U.S. Cl. ..... 29/564.3; 29/33.52; 83/909; 83/924

[58] Field of Search ..... 29/56.5, 33.52, 564.3; 83/909, 924; 209/900

[56] References Cited

U.S. PATENT DOCUMENTS

| | | | |
|---|---|---|---|
| 2,820,282 | 1/1958 | Schneider | 83/909 X |
| 3,643,313 | 2/1972 | Dickinson | 29/56.5 X |
| 4,347,936 | 9/1982 | Fasig | 209/900 X |
| 4,404,723 | 9/1983 | Ohba et al. | 29/33.52 |
| 4,414,730 | 11/1983 | Ohmura et al. | 29/564.3 X |

FOREIGN PATENT DOCUMENTS

| | | | |
|---|---|---|---|
| 2729830 | 1/1979 | Fed. Rep. of Germany | 29/56.5 |
| 101315 | 8/1980 | Japan | 83/924 |
| 738960 | 6/1980 | U.S.S.R. | 83/924 |

*Primary Examiner*—William R. Briggs

*Attorney, Agent, or Firm*—Steele, Gould & Fried

[57] ABSTRACT

A device for removing a band (2) wrapped around a bundle (1) of sheets by means of a cutting device (11). The cutter (7) of the cutting device is arranged on the plane on which the bundle is transported in such a way that it dips into a side face of the bundle, cutting along the entire length of the bundle and thereby severing the band located at right angles to the side face. The severed band (2) is grasped on the side opposite the cutting by a hook (13) of a pull-off device (12) provided opposite the cutting device (11), and removed at right angles to the direction in which the bundle (1) is transported.

16 Claims, 8 Drawing Figures

DEVICE FOR REMOVING A BAND FROM A SHEET BUNDLE

BACKGROUND OF THE INVENTION

1. Field of the Invention

The invention relates to a device for removing a band from a bundle of sheets, comprising a transport device to transport the sheet bundle to a band-removing device in which the band is severed by means of a cutting device and removed from the bundle by means of a pull-off device.

2. Description of the Prior Art

The automatic band-removing of bank-note bundles as used, for example, in completely automatic bank-note sorting machines, is disclosed, for example, in German Offenlegungsschrift 31 18 113.

In the method described here for removing a band wrapped around a bundle of sheets of paper, an end section of the bundle of sheets is clamped mechanically in a band-removing device in such a way that the sheet bundle is arched. This arching causes the part of the band located above the concave portion of the arched sheet bundle to come away from the sheet bundle. The freely exposed section of the band can then be grasped by a correspondingly constructed hook and removed from the sheet bundle. In a further embodiment of the known method, the part of the band exposed by the arching is cut and the band is then removed from the bundle by aid of a suction arm.

In the method described in German Offenlegungsschrift No. 31 18 113, arching of the sheet bundle is necessary in any case for band-removing. For this purpose, additional elements of the device and/or procedural steps must be provided, increasing the expenses related to construction or production and also control. The described method also requires the band to be arranged within a certain area of the sheet bundle. Care must be taken, at least, that the band is not located in the area of the elements provided for arching. The operator of the sorter must therefore perform the corresponding preparatory work.

A critical procedural step in the described band-removing device must be seen in the exposure of a section of the band due to the arching of the bundle. This process is problematic, for example, when the band sticks to the sheet bundle due to electrostatic charges. The one-sided removal of the closed band from the bundle also seems to be critical in the case of the proposed method. The band can easily be twisted or tied up in the process.

SUMMARY OF THE INVENTION

The objective of the present invention is thus to propose a method for removing the band from sheet bundles which guarantees reliable removal of the band independently of the position of the band on the sheet bundle.

The objective is achieved by the features stated in the characterizing part of the main claim.

The inventive device is characterized, among other things, by the fact that the band is severed reliably independently of its position on the bundle. The operator of a sorter thus does not need to orient the band before debanding.

In order to cut the band, the bundle or packet, for example, is led in the clamping of a transport system past a cutting device arranged at a fixed position on the plane of the transport system, to intersect the packet in such a way that its blade extends into the side face adjacent to the device. During the transport of the packet, the blade runs through the entire length of the side face and thereby severs the band located at some point along the packet, at right angles to the side face. The method can be realized with relatively simple constructional elements, not only because no preparatory measures such as the arching of the packet are necessary.

In an advantageous embodiment of the invention, a pull-off device for removing the band is provided on the side opposite the cutting device. A hook in this device intersects the package to extend, like the blade, into the side face of the packet opposite the cutting device. As soon as the part of the band which is at right angles to the side face is in the area of the hook, which is detected by an appropriate sensor, the band, already cut, is grasped and removed from the packet at right angles to the transport system.

Further advantages as well as developments of the invention will become clear on the basis of the embodiment described in the following.

BRIEF DESCRIPTION OF THE DRAWINGS

There are shown in the drawings the embodiments that are presently preferred. It should be understood, however, that the invention is not limited to the precise arrangements shown in the drawings, wherein.

DETAILED DESCRIPTION OF THE PREFERRED EMBODIMENTS

Figure 1:
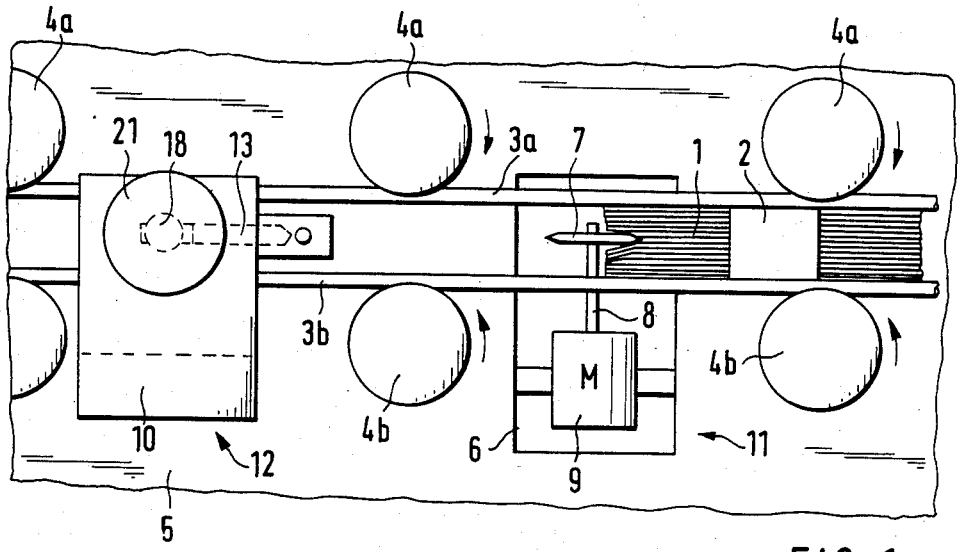
FIG. 1 is a side view of a band-removing device having a cutting and a pull-off device.
Figure 2:
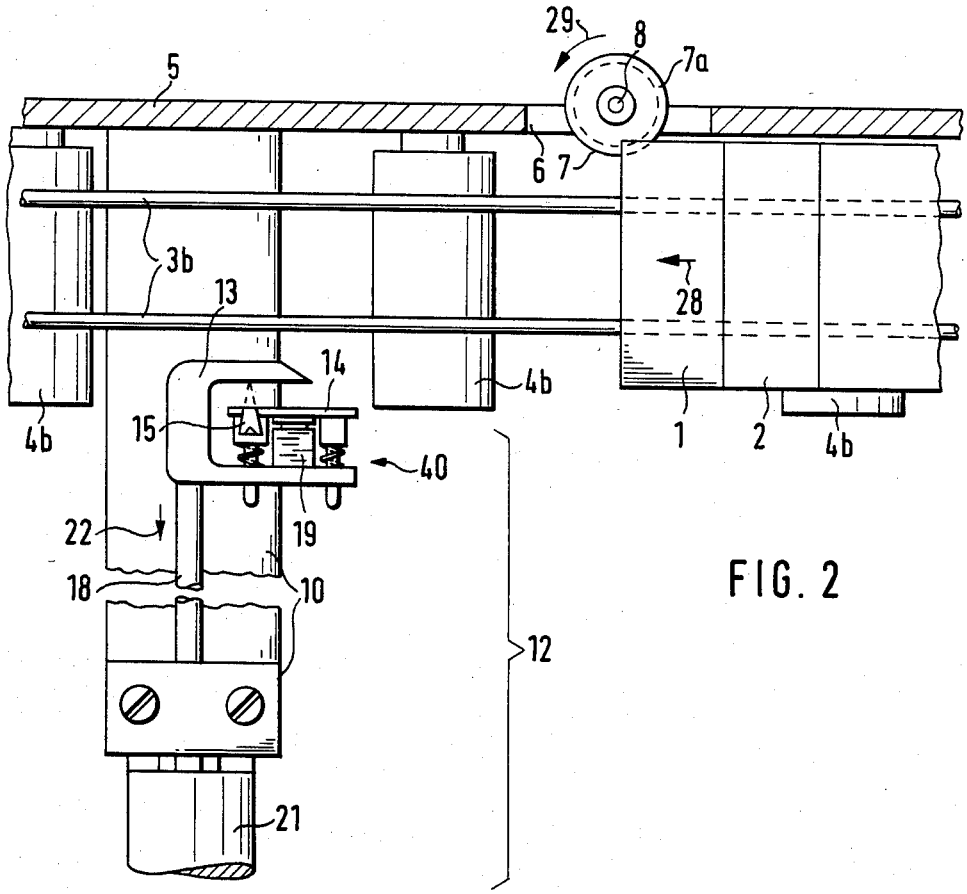
FIGS. 2, 3, 4 are top plan views of the band-removing device of FIG. 1, in three operational phases.

FIGS. 1 and 2 show a band-removing device in a side view and a top view. The sheet bundle 1 provided with a band 2 is conveyed through the device by aid of a transport system consisting of transport rollers 4*a*, 4*b*, mounted in an assembly wall 5, and transport belts 3*a*, 3*b*. In FIG. 2 transport rollers 4*a* with transport belts 3*a* are not indicated, in the interests of a clearer overall view.

In a recess 6 in assembly wall 5 the band cutting device 11 is arranged. It consists of a rotary cutter 7 with blade 7*a*, attached to an axle 8 of a motor 9. Recess 6 may be closed by a dust-proof shield having an opening only for the cutter. The vertical position of axle 8 of the motor with respect to assembly wall 5, which is also the leading edge for the packet, and the horizontal position and the radius of rotary cutter 7 are selected in such a way that the cutter intersects the packet to extend about 2 to 6 mm into the middle of the side face of the packet sliding along the assembly wall. The clearance angle at which the band is severed by the cutter is dependent upon the radius of the cutter and the depth to which the cutter dips or extends into the packet. The angle is selected approximately between 30° and 50°. The mode of operation of the cutting device and constructional features related to it shall be described below.

Figure 5:
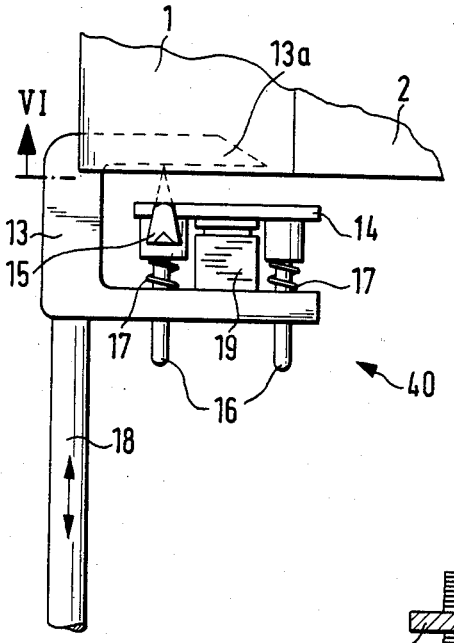
FIG. 5 is a top plan view of the pull-off device.
Figure 6:
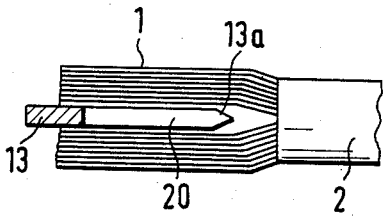
FIG. 6 is a partial section view along line VI in FIG. 5, showing the hook of the pull-off device in the sheet bundle; and, FIGS. *7a* and *7b* are top plan views of the cutting device.

The second element of the band-removing device shown in the figures is pull-off device 12. It is arranged behind cutting device 11 with respect to the direction in which the packet is transported (arrow 28) and, like the cutting device, at approximately the height of the plane on which the packet is transported. A grasping element 40 of pull-off device 12 is movably mounted with a guide rod 18 in a support 10 at right angles to the direction in which the packet is transported. Support 10 is attached to assembly wall 5. Grasping element 40 may be moved, for example, at right angles to the direction in which the packet is transported (arrow 22) by aid of a pneumatic cylinder 21. Grasping element 40 is shown again in detail in FIGS. 5 and 6. It consists of a hook 13 attached to guide rod 18, the free end of the hook 13*a* defining a wedge-shaped tip. The tip of the hook is tapered to penetrate the packet without any difficulty along a side face, widening at an angle as obtuse as possible, so that the tip of the hook does not come in contact in the packet with any dog-eared folds present in single sheets. As shown in FIG. 6, the tip of hook 13 ending in an obtuse angle produces in packet 1 a relatively long wedge-shaped opening, thus avoiding contact between the tip and single sheets. A clamping plate 14 is movably mounted with pins 16 in grasping element 40 opposite the free end 13*a* of the hook. Clamping plate 14 can be attracted by an electromagnet 19 against the force of two springs 17. In the view shown in FIG. 5, clamping plate 14, attracted by the electromagnet, is arranged at a distance from hook 13 so that there is a gap between the hook and the clamping plate into which band 2 runs while the hook slides through the packet between two sheets along the side face of the stack. If the excitation of magnet 19 is switched off, clamping plate 14 presses against hook 13 due to the force of the springs, thereby fixing the band between the clamping plate and the hook. The movement of the band into the hook is detected by a reflecting light barrier. The light barrier is mounted on clamping plate 14 in such a way that its light is well reflected by the bright metallic surface 20 of hook 13 (see FIG. 6). The band covers surface 20 when it has run into the hook, thus reducing the quantity of reflected light.

Cutting device 11 and pull-off device 12 or grasping element 40 are positioned relative to the packet transport in such a way that both cutter 7 and free end 13*a* of hook 13 dip approximately into the middle of the side face of each packet 1. In order to so center the cutter and hook even when the packets are of different thicknesses, transport rollers 4*a*, 4*b* are spring mounted in assembly wall 5 at right angles to the axis of the rollers. The symmetrically spring-suspended clamping guarantees central guiding of packets of different thicknesses relative to the elements of the apparatus such as cutter 7 and hook 13. It also gurantees that the packets are fimly held when the band is removed.

The pull-off device may also be provided opposite the cutting device when the latter is not arranged stationarily but so as to be movable along the side face of the packet.

The mode of operation of the band-removing device shall now be explained with reference to FIGS. 1, 2, 3 and 4 which show three phases of the band-removing operation.

Figure 7A:
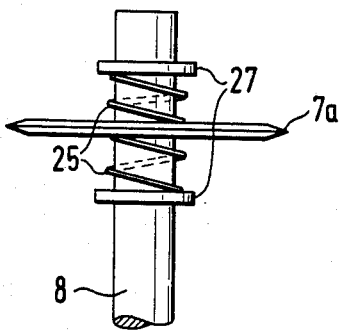
Figure 7B:
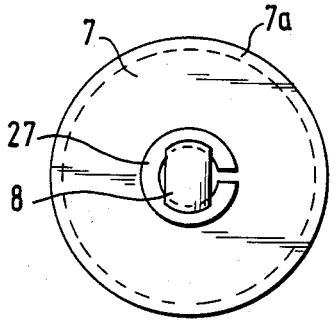

Packet 1 held in the clamping of belts 3*a*, 3*b* is transported in the direction of arrow 28 along assembly wall 5 in such a way that rotary cutter 7 rotating in the direction opposite to the direction (arrow 29) of transport dips into the side face of the packet sliding along the assembly wall (FIGS. 1 and 2). As soon as band 2 comes into the effective range of blade 7*a* of rotary cutter 7, it is necessarily severed. Since the rotating cutter runs between two sheets in the packet, there is a basic possibility of sheets with bends, dog-ears folds or ripples being damaged by the cutter. In order to avoid this, the cutter is mounted so as to be movable axially. As shown in FIG. 7*a*, the cutter is held by aid of clamping rings 27 on axle 8 between two springs 25 in such a way that it can yield to axially displacing forces, especially in the area of blade 7*a*, depending on the force of the springs. The cutter may be floatingly mounted by corresponding selection of the springs so that it can move aside from any folds or similar uneven areas present in the packet. Damage to single sheets is provided. The cutter is, of course, fixed with respect to radially directed forces, which may be easily realized, as shown in FIG. 7*b*, by the non-circular design of axle 8, for example.

As already mentioned, it is assured that the cutter only dips approximately 2 to 6 mm into the side face of a packet. This keeps the effective range of the cutter between the sheets as small as possible in case damage cannot be ruled out due to extreme deformation of a sheet. To assure that the cutter still reliably severs the band, the cutter rotates in the direction opposite to the direction in which the band is moving, at a clearance angle to the band which is as great as possible.

A clearance angle between 30° and 50° has proved to be sufficient. Under the selected conditions, the band is first pressed outwardly from the side of the packet by the blade and then reliably severed. With the opposite direction of rotation for the cutter and too small a clearance angle, there is the danger, due to the small depth of dipping, that the cutter press the band into the side face of the packet and run past it without severing it.

When the band is made of paper, good results are obtained with a rotary cutter as shown in the figures. In general the cutting device must be adapted above all to the material of the band to be treated. For example, a stationary blade, a correspondingly toothed or profiled rotary cutter or a hot wire may be used for plastic bands.

Figure 3:
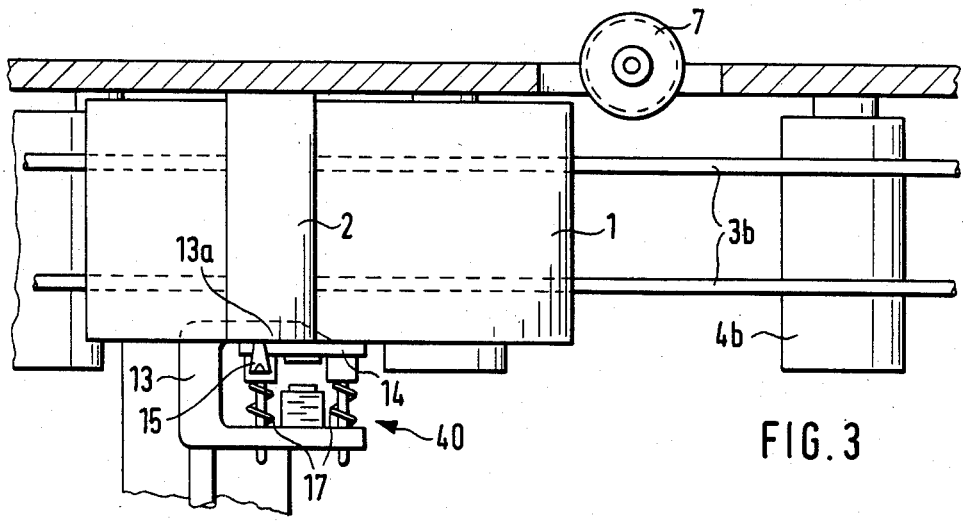

FIG. 3 shows the operational sequence in which band 2 has been cut and has run into hook 13 of grasping element 40 on the side opposite cutter 7. The reflecting light barrier 15 on clamping plate 14 recognizes that the band has run in, whereupon the excitation of the electromagnet is switched off by an appropriate control not shown in the figure. Clamping plate 14 is pressed by the effect of springs 17 against free end 13*a* of hook 13 so that band 2 is fixed in grasping element 40. Since the band is grasped symmetrically with respect to the severed point, it can be reliably removed in the subsequent operational phase from the packet 1 clamped in by transport belts 3*a*, 3*b*.

Figure 4:
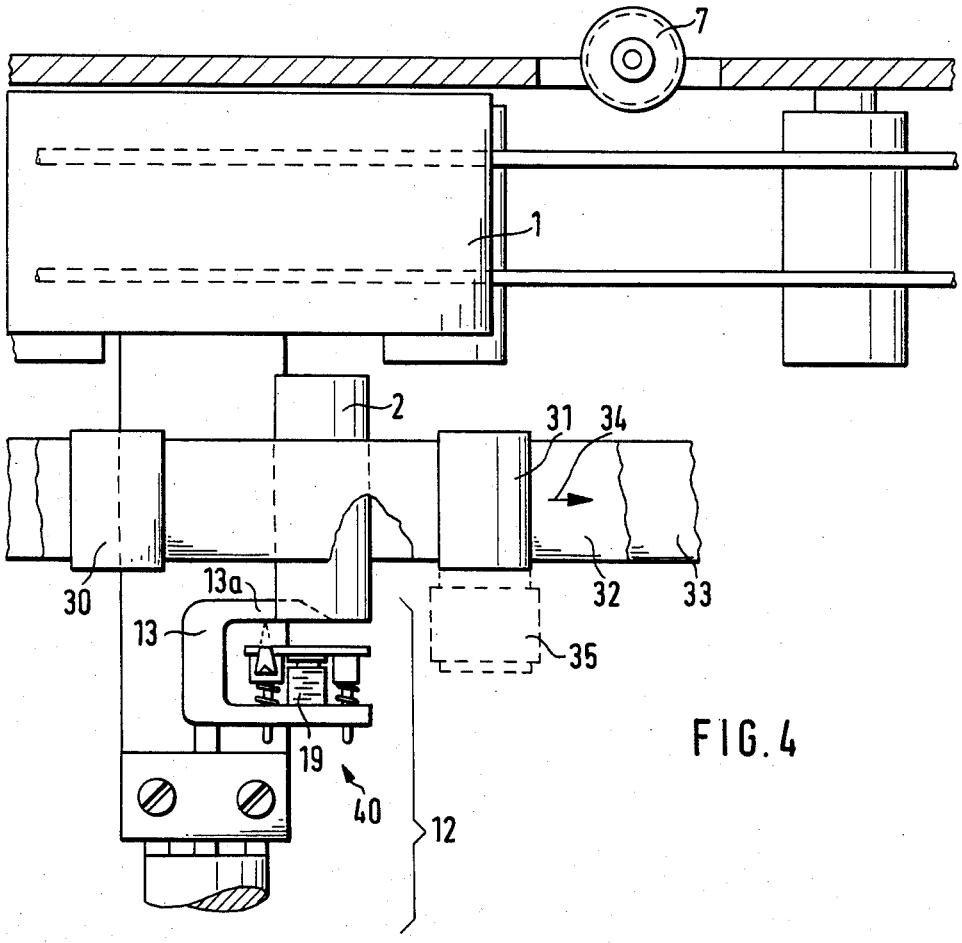

FIG. 4 shows, finally, the phase in which band 2 has been removed from packet 1 and fed to a continuing transport system which is only shown schematically. The band transport system consists of two flat belts 32, 33 which overlap each other and are directed across rollers 30, 31. Flat belts 32, 33 may be moved away from each other at right angles to the drawing plane in the area of pull-off device 12 so that band 2 may be pulled between flat belts 32, 33 by grasping element 40 of pull-off device 12. As soon as the band is located between the flat belts it is clamped in when the flat belts are brought together and may be transported, when the clamping in grasping element 40 has been released by the excitation of electromagnet 19, in the direction of arrow 34 to subsequent treating units.

The band transport system is arranged parallel to the packet transport system and on the same plane. This allows for the band removed from the packet to be transported in a predefined position to subsequent treating units. The band is grasped in such a way that its edges remain freely accessible on both sides of the band transport system, so that the transport of the band may be supervised by appropriate sensors, for example.

The part of the band which was not cut and runs out of free end 13*a* of hook 13 can be bulged more or less in the form of a loop, according to the material of the band and the thickness of the packet. In order to eliminate any disturbances which may result when removing the band, the bulged portion of the band is flattened out as soon as it has left the hook. For this purpose, drum 31 is prolonged accordingly, as shown by broken lines in FIG. 4, and provided with an elastic coating 35.

We claim:

1. A device for removing a band from a bundle of stacked sheets having edges defining opposite side faces of the bundle, the device comprising:

a transport device operable to transport the bundle of sheets past a band-removing device;

a cutting device having a cutting element arranged in a plane parallel to said sheets, the cutting device intersecting one of the side faces and extending into the bundle between the sheets as the bundle is transported; and, a pull-off device for removing the band when severed;

whereby the cutting element cuts throughout the entire length of the bundle, severing the band wherever disposed along the side face of the bundle, without damage to the sheets.

2. A device as in claim 1, wherein the cutting element is a rotary cutter having a direction of rotation opposite to the relative movement of the cutting device and the bundles, as the bundles are transported past the cutting device.

3. A device as in claim 2, wherein the rotary cutter is axially displaceable, whereby the cutter can turn aside from any uneven areas in the bundle as required to stay between the sheets.

4. A device as in claim 3, wherein the rotary cutter extends approximately 2 to 6 mm into the side face of the stack and defines a clearance angle with respect to the band of approximately 30 to 50 degrees.

5. A device as in claim 1, wherein the cutting element is a stationary blade past which the bundle is transported.

6. A device as in claim 1, wherein the pull-off device has a grasping element operable to grasp the band at the side face of the stack opposite the side face of the stack receiving the cutting element, the grasping element being movable to remove the band from the bundle in a direction perpendicular to a direction in which the bundle is transported.

7. A device as in claim 6, wherein the grasping element has a hook having a free, pointed end intersecting the side face of the bundle, the hook passing between the sheets and grasping the band from behind said opposite side face.

8. A device as in claim 7, wherein the free-pointed end of the hook has a blunt wedge shape whereby an extreme end point of the hook is spaced from uneven areas in the sheet bundle.

9. A device as in claim 7, wherein the hook is movable between an advanced position in which the hook extends through said opposite side face of the bundle and a retracted position in which the hook is located outside the bundle.

10. A device as in claim 9, further comprising a clamping plate opposite the free end of the hook, the clamping plate being movable between an open position in which the clamping plate is spaced from the free end of the hook and a clamping position in which the clamping plate is adjacent to the free end of the hook, the clamping plate being retractable from the bundle together with the hook.

11. A device as in claim 6, further comprising a sensor operable to detect presence of the band on the bundle, a signal from the sensor triggering operation of the grasping element.

12. A device as in claim 11, wherein said sensor includes a light reflective surface between the free end of the hook, which free end extends into the bundle and a transmittor-receiver element arranged outside the bundle and directed toward said surface.

13. A device as in claim 6, wherein the pull-off device is arranged downstream of the cutting device with respect to the direction in which the bundle is transported.

14. A device as in claim 1, wherein the bundle transport system further comprises rollers arranged opposite each other at right angles to the direction of transport, the rollers being spring-mounted perpendicular to the direction of transport.

15. A device as in claim 6, further comprising a band transport system is parallel to the direction in which the bundle is transported and on the same plane, the band transport system having means for receiving the band when removed from the bundle and a roller operable to flatten the band before the band is transported away further.

16. A device as in claim 1, wherein the cutting element is a hot wire and the bundle is transported past the cutting element.

* * * * *